United States Patent [19]

Riggs

[11] 4,339,151

[45] Jul. 13, 1982

[54] HEAD RESTRAINT

[76] Inventor: Eric D. Riggs, 20010Ferguson St., Detroit, Mich. 48235

[21] Appl. No.: 111,955

[22] Filed: Jan. 14, 1980

[51] Int. Cl.[3] ..... A47C 31/00; A47D 15/00

[52] U.S. Cl. ..... 297/464; 2/DIG. 11; 128/133; 244/122 AG; 297/393; 297/397

[58] Field of Search ..... 244/122 R, 122 A, 122 AG, 244/122 B; 280/748, 801, 808; 297/464, 465, 466, 468, 486, 393, 391, 392, 397, 398, 400, 406, 399, 217; 269/328; 128/133, 134; 2/171, 171.8, DIG. 11

[56] References Cited

U.S. PATENT DOCUMENTS

| | | | |
|---|---|---|---|
| 2,452,103 | 10/1948 | Conradt et al. | 297/217 |
| 2,520,710 | 8/1950 | Brown | 128/134 |
| 2,582,571 | 1/1952 | Thoma | 297/397 |
| 2,726,714 | 12/1955 | McAndrews | 138/134 |
| 3,170,659 | 2/1965 | Wood | 244/122 B |
| 4,024,861 | 5/1977 | Vincent | 128/134 |
| 4,182,322 | 1/1980 | Miller | 128/133 |

*Primary Examiner*—Charles E. Frankfort

*Attorney, Agent, or Firm*—Basile, Weintraub & Hanlon

[57] ABSTRACT

A head restraint for supporting the user's head while seated in a chair is disclosed. The head restraint of the present invention comprises a strap adapted to be wrapped around the back of a chair and an adjustable headband secured to a central forward portion of the strap. The headband is adjustable and comprises a head strap with a pair of open ends having an adhesive patch with adhesive attached to opposed surfaces affixed to one end of the head strap. Another end of the head strap is engageable with the patch to enable the head strap to encircle the user's head securing the head strap thereto. In a preferred embodiment the strap and the head strap are made from disposable paper strips foldable into a compact planar form for storage in the user's pocket. The head restraint is readily disposable after use.

4 Claims, 5 Drawing Figures

20
22
26
12
16
24
10
32
30
28
14
13
11
21
23
25
112
114
116
110

HEAD RESTRAINT

BACKGROUND OF THE INVENTION

I. Field of the Invention

The present invention generally relates to the field of head restraints, and in particular, the present invention is concerned with head restraints for use by individuals while seated in a chair. More particularly the present invention is concerned with head restraints for the use of individuals while seated in a chair that are foldable into a planar form for storage in the user's pocket, and are readily disposable after use.

II. Description of the Prior Art

Restraints in the prior art known to the applicant include head restraints for use in space vehicles and manned military hardware.

U.S. Pat. No. 3,170,659 is typical of the head restraint devices used in association with military vehicles and space hardware. This U.S. patent rigidly secures the user's head to the seat of the vehicle.

The prior art also discloses restraints of a tethering type employed to restrict the movement of children while traveling in vehicles. U.S. Pat. No. 2,619,362 discloses a restraint and cushioning device for tethering children or restricting their movement in a motor vehicle.

U.S. Pat. No. 4,097,086 discloses a body restraint for supporting persons while sleeping upright in a chair. The device disclosed in this U.S. patent employs a strap encircling the back of the chair and the torso of the user. The device also discloses a pillow attachable at one end to the strap against which the user may rest his head. There is no restraint for the head of the user in this U.S. patent.

SUMMARY OF THE INVENTION

The present invention, which will be described in greater detail subsequently, comprises a head restraint for supporting the user's head to limit the movement thereof if the user falls asleep while seated in a chair and includes a strap adapted to be secured around a back of the chair and an adjustable headband secured to a central forward portion of the strap. The strap of the present invention is secured to the chair back by a pair of strings affixed at the strap ends, the strings being knotted together to attach the strap to the chair. The adjustable headband of the present invention comprises a head strap secured to a central forward portion of the strap. An adhesive patch with adhesive on opposed surfaces is affixed to one end of the head strap with another end of the head strap releasably engageable with the patch to encircle the user's head and secure the head strap ends together. In a preferred embodiment the head restraint is made from foldable paper strips that are collapsible into a compact planar form for storage in the pocket of the user. The head restraint is made from inexpensive materials that can be discarded after use with little economic consequence.

It is therefore a primary object of the present invention to provide a new and improved head restraint for supporting the user's head while seated in a chair.

It is a further object of the present invention to provide a new and improved head restraint for supporting the user's head while seated in a chair which includes a strap secured to the chair back and an adjustable headband secured to the strap.

It is yet another object of the present invention to provide a new and improved head restraint for supporting the user's head that can be made economically from paper strips.

It is a further object of the present invention to provide a new and improved head restraint for supporting the user's head made from economical paper strips that are foldable into a compact planar package for storage.

It is yet another object of the present invention to provide a head restraint for supporting the user's head that is made from economical paper strips foldable into a compact planar package for storage and which is readily disposable after use with little economic consequence.

Further objects, advantages, and applications of the present invention will become apparent to those skilled in the art to which this invention pertains, when the accompanying description of one example of the best mode contemplated for practicing the invention is read in conjunction with the accompanying drawing.

BRIEF DESCRIPTION OF THE DRAWING

In the drawing like reference numbers refer to like parts throughout the several views, and wherein.

DESCRIPTION OF THE PREFERRED EMBODIMENTS

Figures 1, 2, 3, 4, 5:
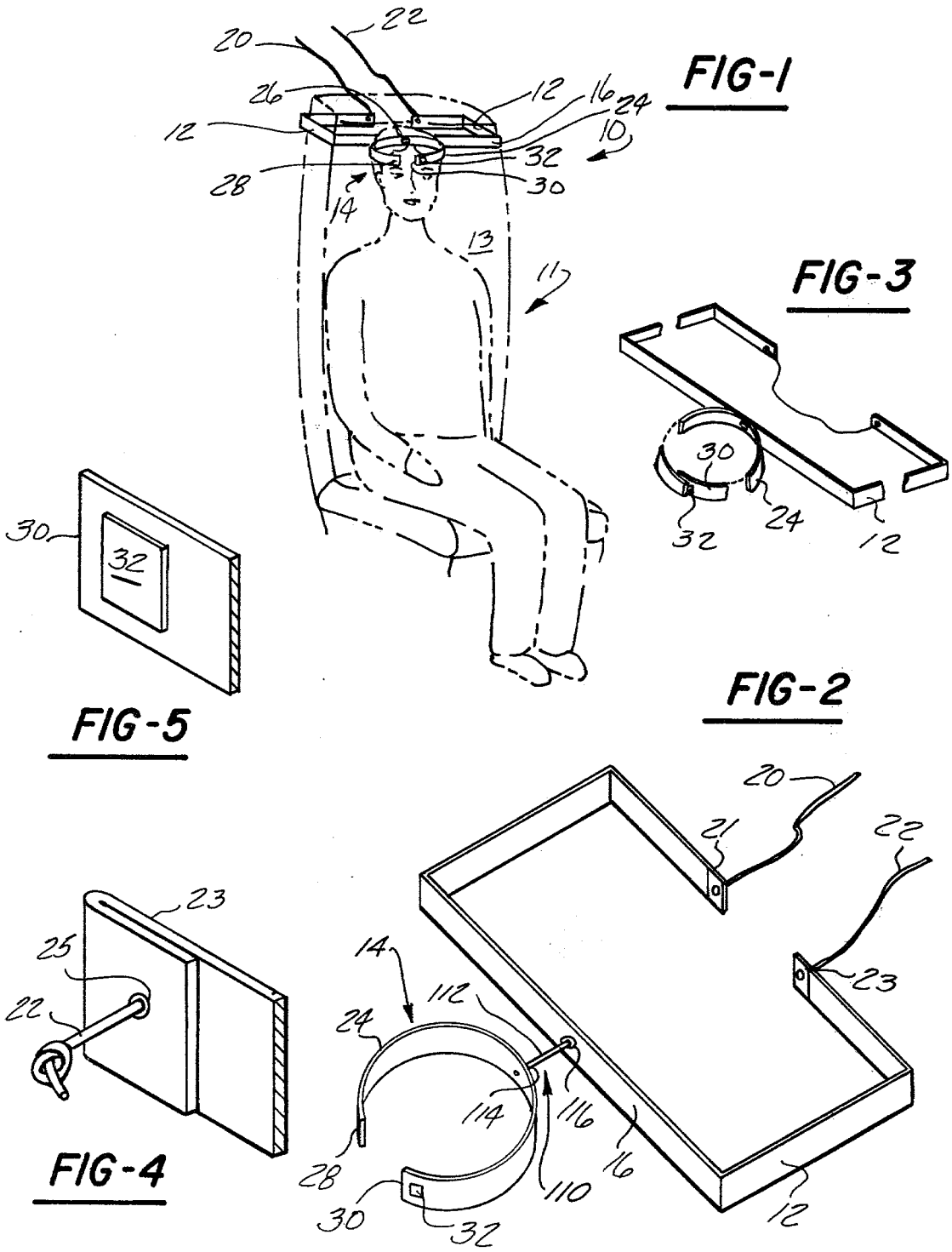
FIG. 1 illustrates a perspective view of a preferred embodiment of the present invention as affixed to the back of a chair.
FIG. 2 illustrates a perspective view of a preferred embodiment of the present invention.
FIG. 3 illustrates a broken enlarged perspective view of another preferred embodiment.
FIG. 4 illustrates a broken enlarged perspective view of the band ends illustrated in FIGS. 1 and 2.
FIG. 5 illustrates a broken perspective view of an end of the headband illustrating an adhesive patch affixed thereto.

Referring now to the drawing, there is illustrated one example of the present invention in the form a head restraint 10 in FIGS. 1 and 2. The head restraint 10 is adapted to support the user's head while seated in a chair 11. The head restraint 10 comprises a strap 12 wrapped around the chair back 13 and an adjustable headband 14 secured to a central forward portion 16 of the strap 12. The strap 12 can be secured to the chair back 13 by means of a pair of strings 20,22 that are selectively knotted or tied together.

The adjustable headband 14 comprises a head strap 24 secured at a central portion thereof to the central forward portion 16 of the strap 12 by a fastener 26 such as a rivet or staple. Alternately the head strap 24 could be secured to the central portion 16 of the strap 12 by utilizing an adhesive, or other means, such as tape, or the like. The head strap 24 further includes a pair of strap ends 28,30 that are adjustably joined together by an adhesive patch 32 (FIG. 5) having adhesive on opposed surfaces. Likewise, intermeshing "Velcro" patches can be used in view of the patch 32. The adhesive patch 32 is affixed to one end 30 of the head strap 24, and another end 28 of the head strap is engageable with the adhesive path 32 to encircle the user's head and secure the head strap 24 thereto. Preferably, the adhesive surface is covered with a removable strip until ready for engagement with the other end 28. Ends 21,23, FIG. 3, of the strap 12 are disposed at a rear portion of the seat back 13 in an opposed manner, and the strings 20,22 are affixed thereto in a manner which will be described subsequently.

The ends 21,23 of the strap 12 are identical and the construction of one of the ends is illustrated in FIG. 4 wherein the end 23 is folded over upon itself to form a thickened reinforced portion. The ends 21,23 can be reinforced with any other means, such as being wrapped with a fibrous reinforcing tape around the end or the like. An aperture 25 is formed through the reinforced portion to receive an end of the string 22. The string 22 projects through the aperture 25 and is knotted as illustrated in FIG. 4 to secure the string 22 to the end 23. The strings 20,22 are then knotted together or tied in a manner to secure the strap 12 to the seat back 13. Of course, a single string which threads through the aperture 25 can be used, as shown in FIG. 3.

FIG. 2 of the drawing illustrates at 110 another embodiment of the present invention wherein the head band 24 is secured to the central portion 16 of the strap 12 by means of a short tether 112 which is secured at a first end 114 to the central portion of the head strap 24 and at a second end 116 to the front central portion of the strap 12. This embodiment allows the user to freely move his head within the limits of the tether 112 but his head is still supported should the head sway forwardly and laterally when the user falls asleep. The ends of the tether 112 may be affixed to the strap 12 and the head strap 24 in the manner illustrated in FIG. 4 or by employing a fastener such as a rivet or staple to secure the ends of the tether to the respective members to which they attach.

In both embodiments the head restraint 10 has the strap 12 and the head strap 24 formed from disposable paper strips which are foldable along suitably formed fold lines to enable the head restraint to be collapsed to a compact planar form for storage in the pocket of the user when not in use. By making the straps of the head restraint from an inexpensive item such as paper the entire restraint can be conveniently disposed of without significant economic consequence. Also, the device in its folded form may be readily made available from vending machines at airports and bus terminals.

It can thus be seen that the present invention has provided a new and improved head restraint for supporting the user's head while seated in a chair. The head restraint of the present invention is economical to produce, convenient to store and transport, and can be readily disposed of with little economic consequence.

It should be understood by those skilled in the art to which this invention pertains, that other forms of the applicant's invention may be had, all coming within the spirit of the invention and the scope of the appended claims.

Having thus described my invention what I claim is:

1. A head restraint for supporting the user's head while seated in a chair comprising:

a strap having ends adapted to be secured in an encircling manner around a chair back; and an adjustable headband secured to a central forward portion of the strap and adapted to encircle the user's head, the adjustable headband comprises a head strap secured to the central forward portion of the strap and having an adhesive patch with adhesive on opposed surfaces affixed to one end of the head strap with another end of the head strap being engageable with the adhesive patch to secure the head strap around the head of the wearer; and wherein the headband and strap encircling the chair back are made from paper strips.

2. The head restraint as defined in claim 1 wherein the strap encircling the chair back further comprises:

a pair of strings affixed to the strap ends, the strap secured to the chair by encircling the chair back and tying the string ends together.

3. The head restraint as defined in claim 1 wherein the headband is movably connected to the strap encircling the chair back by a tether having a first end secured to the central forward portion and a second end secured to the headband.

4. The head restraint as defined in claim 1 wherein the strap encircling the chair back and the headband are foldable into a compact planar form for storage in the pocket of the user.

* * * * *